US005671617A

United States Patent [19]

Park et al.

[11] Patent Number: 5,671,617

[45] Date of Patent: Sep. 30, 1997

[54] CLOTHES WASHING MACHINE HAVING A WATER PASSAGE FOR DISCHARGING WATER DOWNWARDLY UPON LAUNDRY BEING WASHED

[75] Inventors: Joo Heum Park, Seoul; Sang Han Kim, Suwon, both of Rep. of Korea

[73] Assignee: Samsung Electronics Co., Ltd., Suwon, Rep. of Korea

[21] Appl. No.: 640,020

[22] Filed: Apr. 30, 1996

[30] Foreign Application Priority Data

May 16, 1995 [KR] Rep. of Korea ..... 95-12097

[51] Int. Cl.[6] ..... D06F 17/06

[52] U.S. Cl. ..... 68/53

[58] Field of Search ..... 68/53, 18 F, 133, 68/134

[56] References Cited

U.S. PATENT DOCUMENTS 2,270,750 1/1942 Bariffi ..... 68/18 F 5,509,283 4/1996 Lee et al. ..... 68/53 X

FOREIGN PATENT DOCUMENTS 6-54981 3/1994 Japan .

*Primary Examiner*—Philip R. Coe

*Attorney, Agent, or Firm*—Burns, Doane, Swecker & Mathis, L.L.P.

[57] ABSTRACT

A clothes washer includes a laundry tub assembly disposed within a stationary main water tub. The laundry tub assembly includes outer and inner tubs rigidly attached together and radially spaced apart to form therebetween a space having a lower water inlet and an upper water outlet. A pulsator is disposed within the tub assembly to agitate clothes during a washing operation. The pulsator oscillates about a vertical axis and thereby produces streams of water traveling upwardly through the space and from the outlet to fall onto clothes being washed, in order to push the clothes downwardly. Spirally arranged members are disposed within the space to impart a swirling motion to the water traveling therethrough, so that the water discharged from the water outlet travels in generally the same direction as the direction of rotation of the pulsator and thus in the same direction as the clothes.

10 Claims, 8 Drawing Sheets

CLOTHES WASHING MACHINE HAVING A WATER PASSAGE FOR DISCHARGING WATER DOWNWARDLY UPON LAUNDRY BEING WASHED

BACKGROUND OF THE INVENTION

The invention is related to a washing machine, and in particular, to a water channel formed between inner to outer tubs along which the water is upwardly forced to shower down on the laundry.

PRIOR ART

A washing machine generally provides a control unit in which a program for selecting desired washing, rinsing, draining and spinning modes is programmed in advance. The program is selected to perform the adaptable mode. The sequence of modes is fully automatic.

A fully automatic washing machine, as shown in FIG. 1, is provided with a water tub 2 which is fixedly mounted in a housing 1 for containing a predetermined volume of water. Further, the washing machine is provided with a laundry tub 3 and a pulsator 4 mounted in the water tub 2, and a power mechanism 5 mounted underneath the water tub 2 for transferring the power needed for washing.

The power mechanism 5 is provided with a driving motor 5*a* for generating power and a power transmission member 5*b* for transmitting the power of the driving motor 5*a* to the laundry tub 3 and the pulsator 4.

A flow guiding channel 3*a* is formed on a portion of the inner side of the laundry tub 3 through which the water flows.

The flow guiding channel 3*a* is comprised of an inlet 3*b* formed at the lower portion thereof for intaking water in the washing and the rinsing modes, an outlet 3*c* formed at the upper portion thereof for discharging the flowing water and a filter member 3*d* detablably mounted at the outlet 3*c* for collecting lint in the discharging water through the outlet 3*c*.

When in the washing or rinsing mode, the pulsator 4 receives the power of the driving motor 5*a* and is rotated intermittedly, performing the washing or rinsing cycle.

The pulsator 4 is used as an impeller. Part of the water is forcefully fed through the inlet 3*b* of the channel 3*a* by rotational force of the agitator.

The water passing through the inlet 3*b* is discharged through the outlet 3*c* during rotation of the pulsator 4. The circulation of the water is repeated.

During the predetermined program period the process is repeatedly performed and subsequently the lint is collected in the filter member 3*d*.

While the washing machine can develop the efficiency for collecting lint, the below disadvantage can follow.

During the washing or rinsing mode, a water flow is generated inside the laundry tub 3 by the rotation of the pulsator. The laundry may follow the movement of the water stream and can rise up along the inner wall of the laundry tub, exposing the laundry above the water level.

Performing the washing operation with the laundry insufficiently immersed in the water causes the washing efficiency of the washing machine to be reduced.

Accordingly, one object of the invention is to provide a washing machine resolving the problem.

Another object of the invention is provide a washing machine, including a spiral swirling member on a laundry tub, to submerge the rising laundry under the water level.

SUMMARY OF THE INVENTION

In order to accomplish these objects, a washing machine comprises a water tub; a laundry tub movably mounted on the longitudinal axis in the tub and including a bottom wall and a vertical wall; an inner tub fixedly mounted in the laundry tub for supplying water on the bottom wall toward the upper portion of the vertical wall through a space formed between the inner tub and the vertical wall of the laundry wall; a pulsator mounted above the bottom wall of the laundry tub and being rotated around the longitudinal axis and having a plurality of radial vanes for discharging water radially and a swirling means for discharging the flowing water along the space in the corresponding rotational direction of the pulsator.

BRIEF DESCRIPTION OF THE DRAWINGS

The invention now will be described in detail with reference to the accompanying drawings, in which.

DETAILED DESCRIPTION OF PREFERRED EMBODIMENTS OF THE INVENTION

Figure 1:
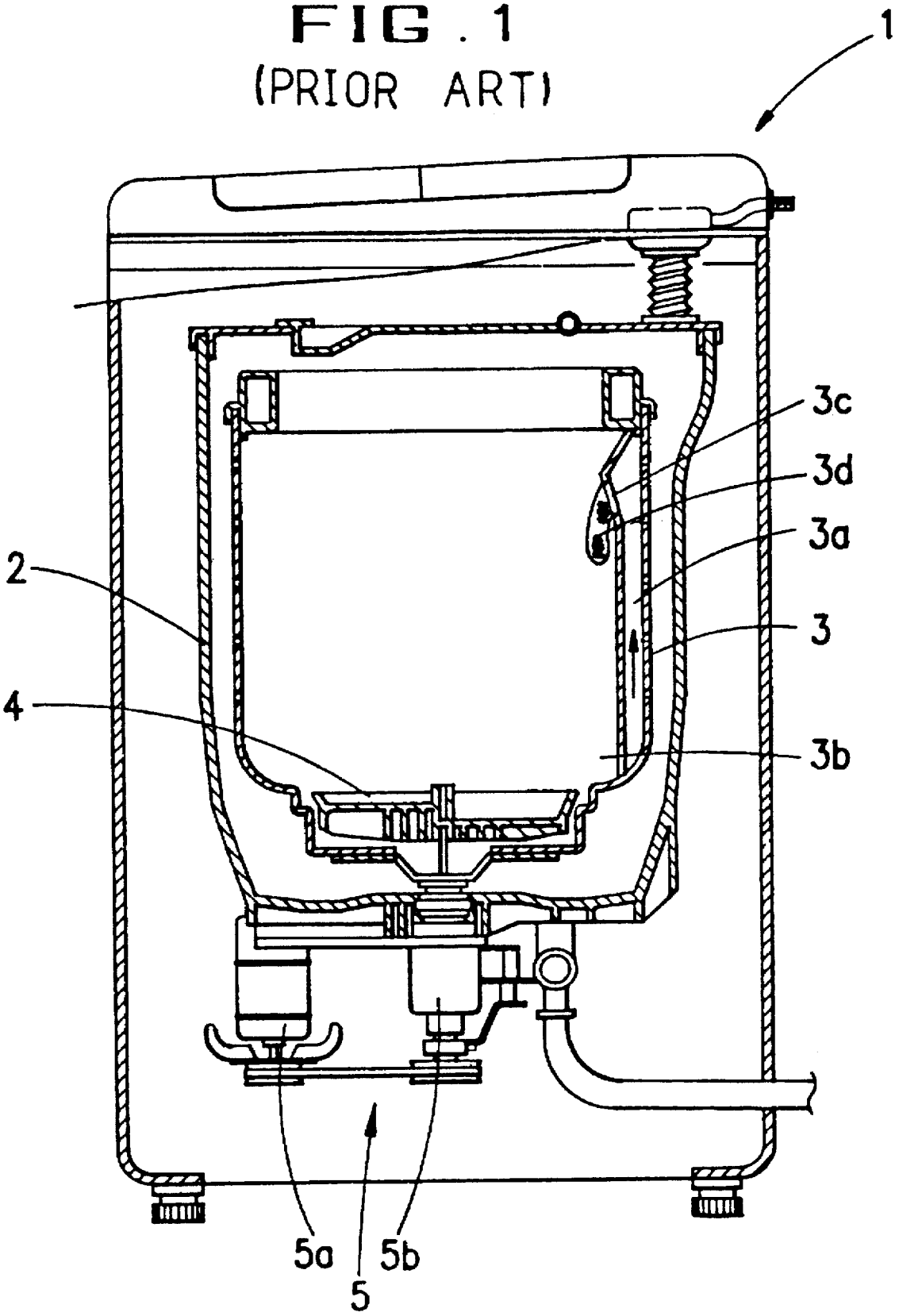
FIG. 1 (PRIOR ART)
FIG. 1 is a schematic cross-sectional view showing a washing machine of a prior art.

FIGS. 2A through 4 show one embodiment of the washing machine according to a present invention.

In a housing 10 a main water tub 20 is provided fixedly for containing a predetermined volume of water. In the main water tub 20 a laundry tub assembly comprised of outer and inner tubs 30, 40 is provided for serving as a water extractor, and both tubs 30, 40 are provided with a plurality of openings 32. A liquid balancer is provided on the top circumference of the outer tub 30.

The inner tub 40 is mounted integrally with the outer tub 30 by a fixing means 50 and is spaced from the outer tub 30.

The inner tub 40 is shaped like a drum. A lower portion of the inner tub 40 is bent to form an inlet 41, through which part of the water on the bottom wall of the main water tub 20 comes in. An upper portion of the inner tub 40 is spaced from the lower part of the liquid balancer 31 to form an outlet 42 for discharging the water fed through the inlet 41.

The fixing means 50 is used for attaching the inner tub 40 to the outer tub 30 in an integral manner. A plurality of bosses 51 are provided on either an inner surface of the outer tub 30 or an outer surface of the inner tub 40. A fixing member 52 is inserted in the boss 51 for coupling the outer tub 30 and the inner tub 40.

Under the main water tub 20 a power transmission means 60 is provided for transferring power of a motor to the tub assembly i.e. the outer tub 30 and the inner tub 40. In the tub assembly a pulsator 70 is provided having on its underside a plurality of vanes 71 rotated by the rotation of the power transmission means.

Further, a water swirling means 80 is provided in the space between the outer tub 30 and the inner tub 40. The water in the bottom of the outer tub 30 is forcefully fed into the space by the clockwise or counterclockwise rotation of the pulsator 70 and is discharged toward the inner wall 40 by the water swirling means 80.

Figure 3A:
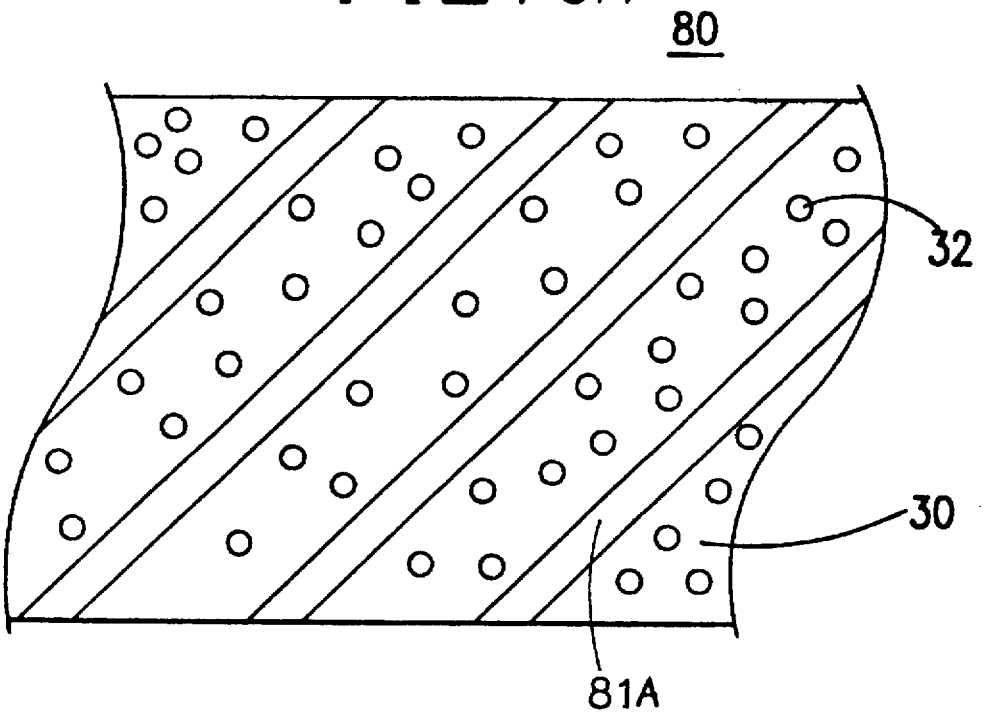
FIG. 3A is a schematic cross-sectional view taken along line A—A of FIG. 2A, showing a swirling means.
Figure 3B:
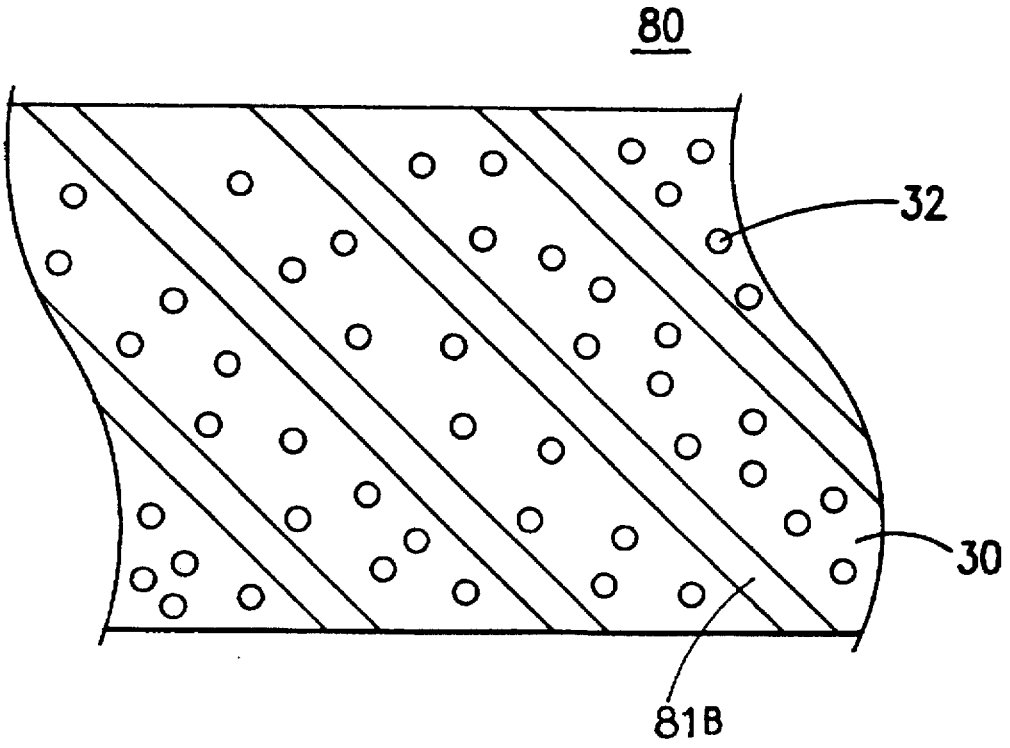
FIG. 3B is a schematic cross-sectional view taken along line B—B of FIG. 2A, showing a swirling means.
Figure 4:
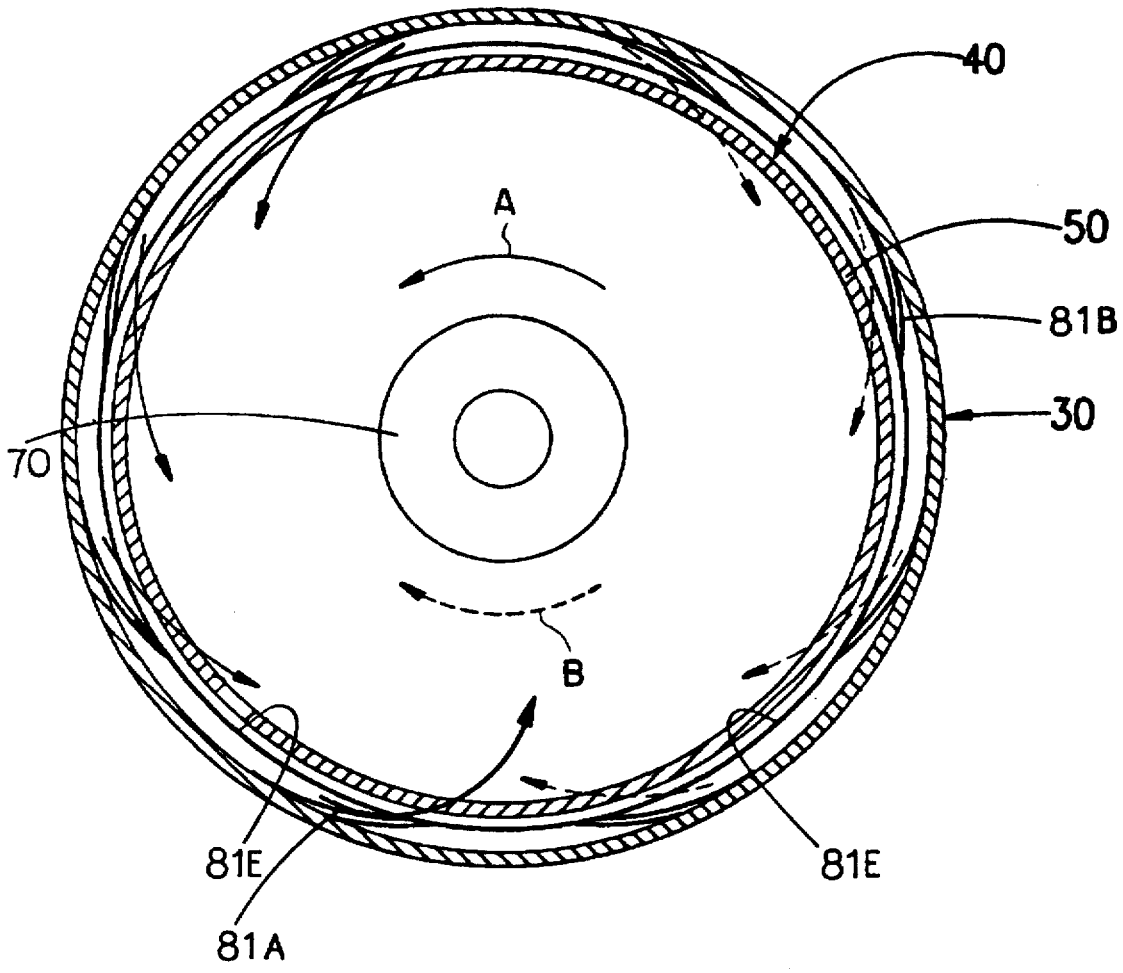
FIG. 4 is a plan view showing a water discharge mode.

The water swirling means 80, shown in FIGS. 3A, 3B and 4, is comprised of a plurality of swirling members or collars 81A, 81B formed on the inner wall of the outer tub 30. The swirling members or collars 81A are opposed relative to the swirling members or collars 81B in a symmetrical manner around a rotation shaft of the pulsator 70. That is, the collars 81A are confined to one-half of the circumference of the tub 30 for directing water counterclockwise (see the solid arrows in FIG. 4), whereas the collars 81B are confined to the remaining half of the tub circumference for directing water clockwise (see the broken-line arrows in FIG. 4). Respective side edges 81E of the swirling members or collars 81A, 81B are spaced radially outwardly from the outer surface of the inner tub 40. The collars 81A,81B are spirally formed and extend to the upper portion of the outer tub 30 or the outlet 42 from the lower portion or the inlet 41.

Figure 5A:
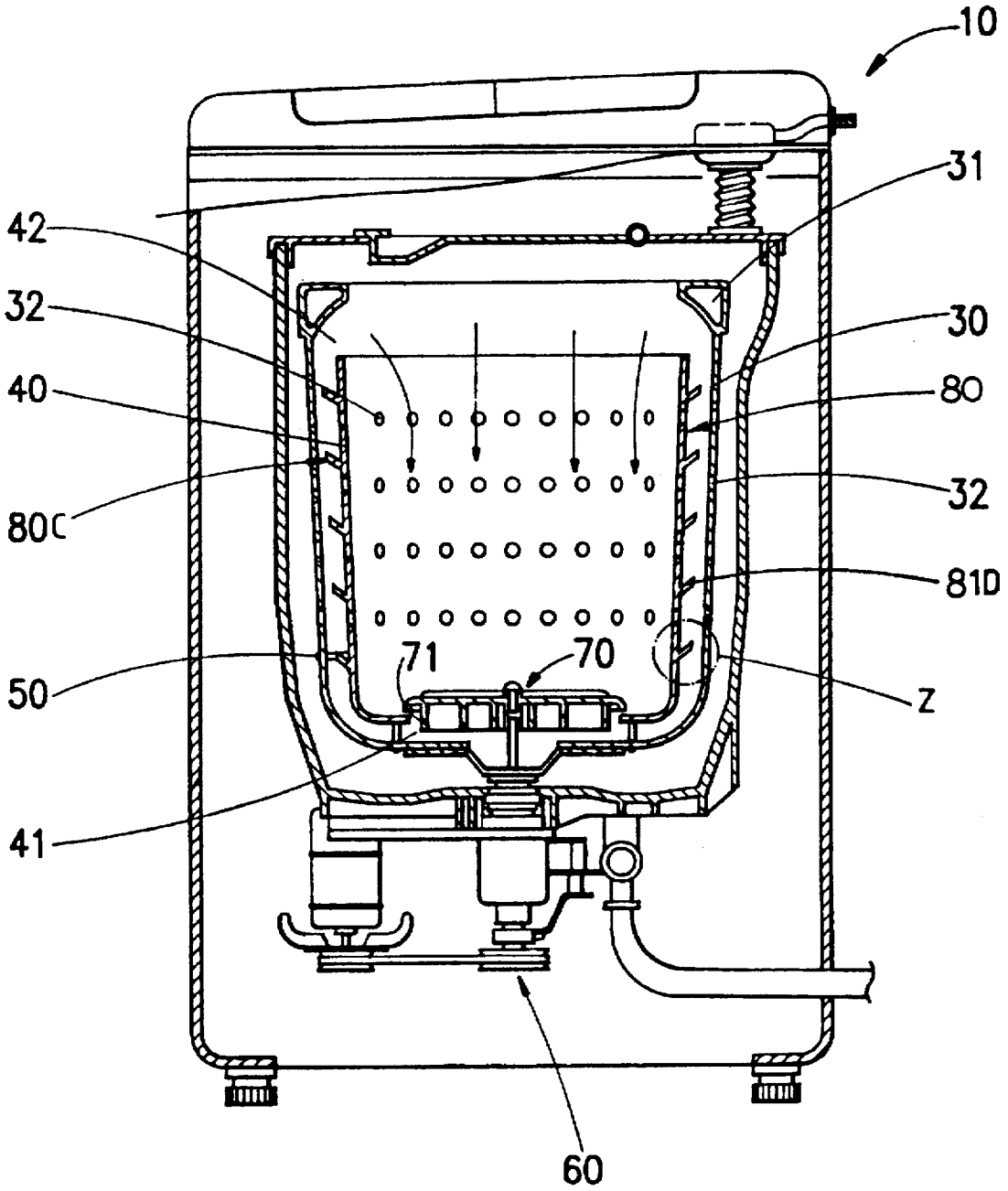
FIG. 5A is a schematic cross-sectional view showing another embodiment of a washing machine according to the invention.
Figure 5B:
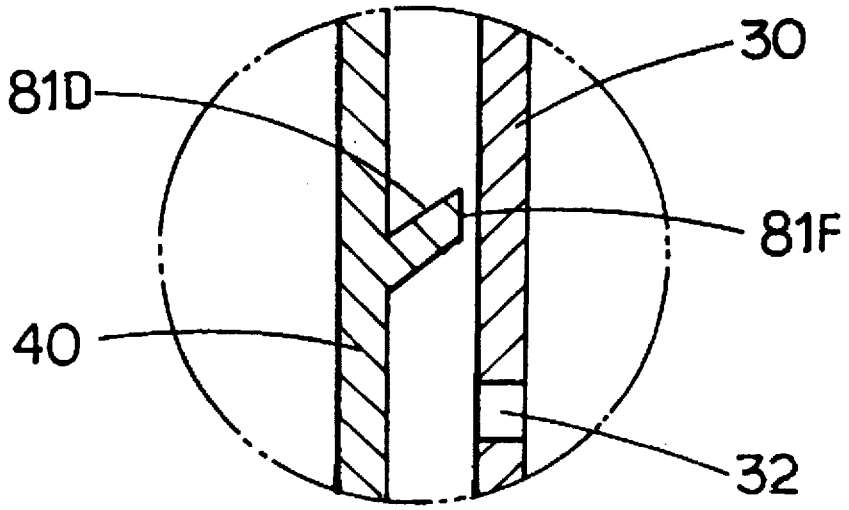
FIG. 5B is a schematic cross-sectional view showing the portion of FIG. 5A disposed in a circle Z.
Figure 6:
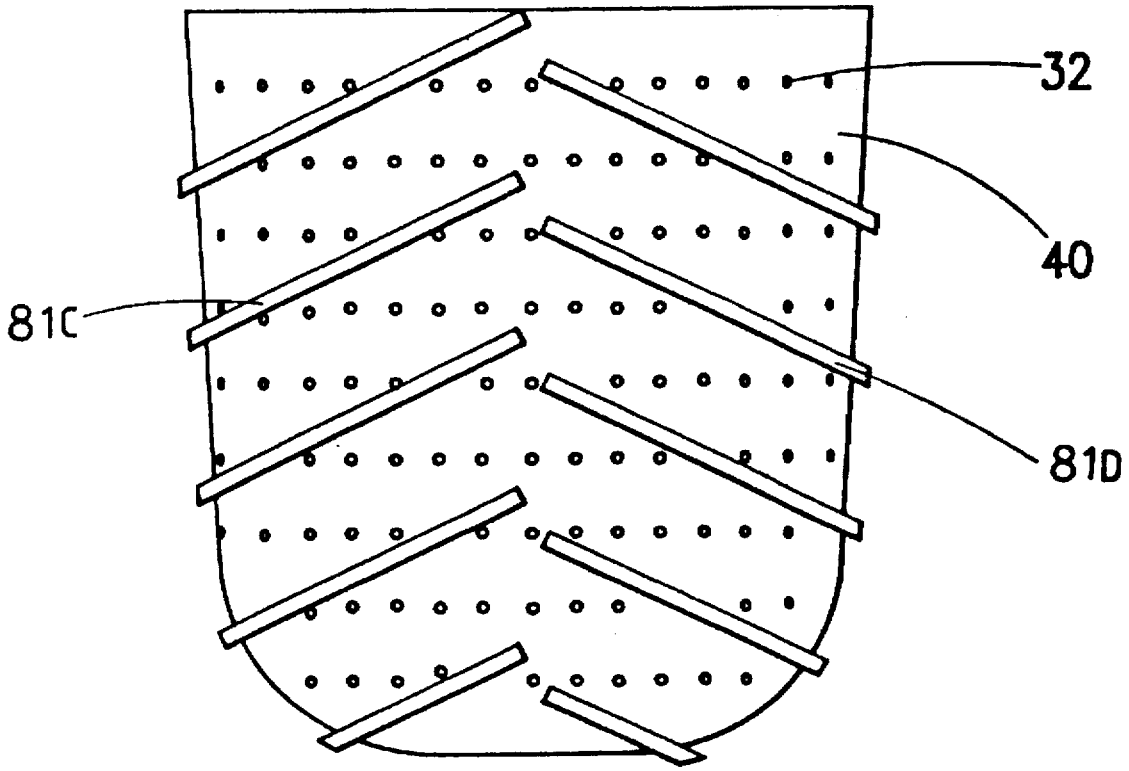
FIG. 6 is a schematic side view of an inner wall of FIG. 5A.

Alternatively the water swirling means 80 may be formed as shown in FIGS. 5A, 5B and 6. Wherein in swirling members or collars 81D and 81C are mounted on the inner tub 40 instead of on the outer tub 30. As in the previous embodiment, the members 81C are opposed relative to member 81D and are arranged in a symmetrical manner around a rotation shaft of the pulsator 70. Respective side edges 81F of the swirling members or collars 81C, 81D are spaced from the inner surface of the outer tub 30.

Figure 2A:
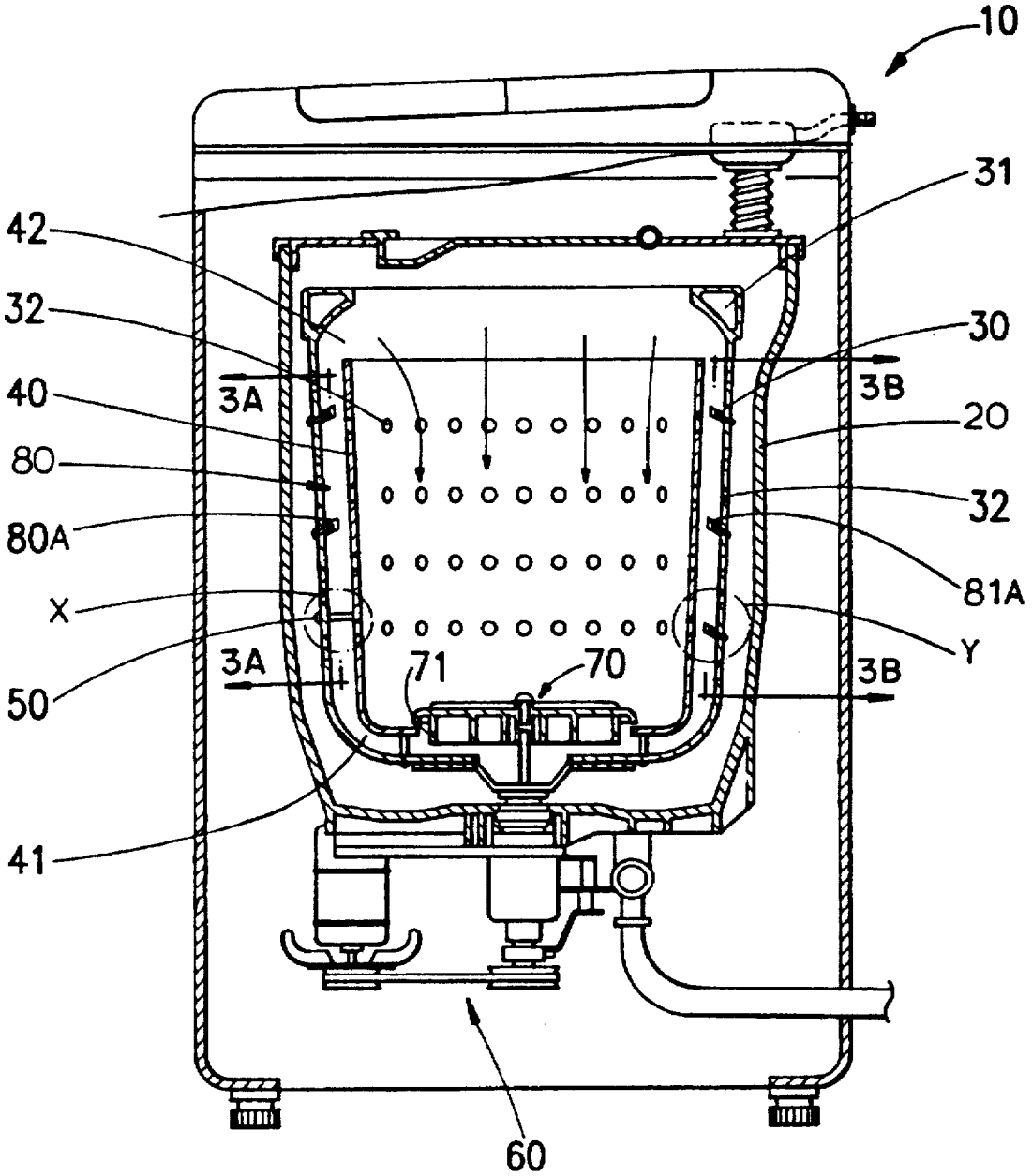
FIG. 2A is a schematic cross-sectional view showing one embodiment of a washing machine according to the invention.
Figure 2B:
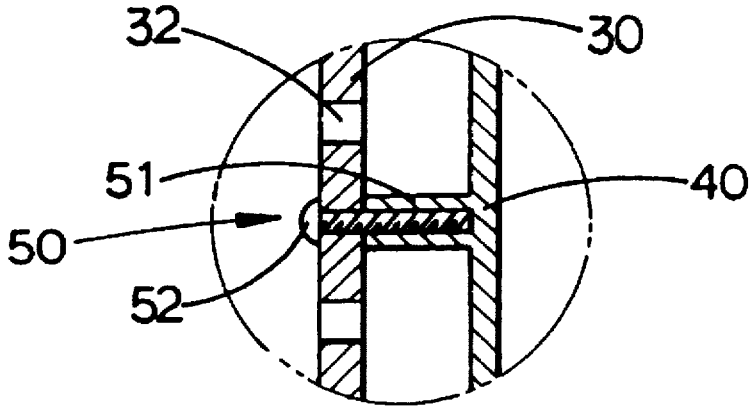
FIG. 2B is an enlarged cross-sectional view showing the portion of FIG. 2A disposed in a cirle X.
Figure 2C:
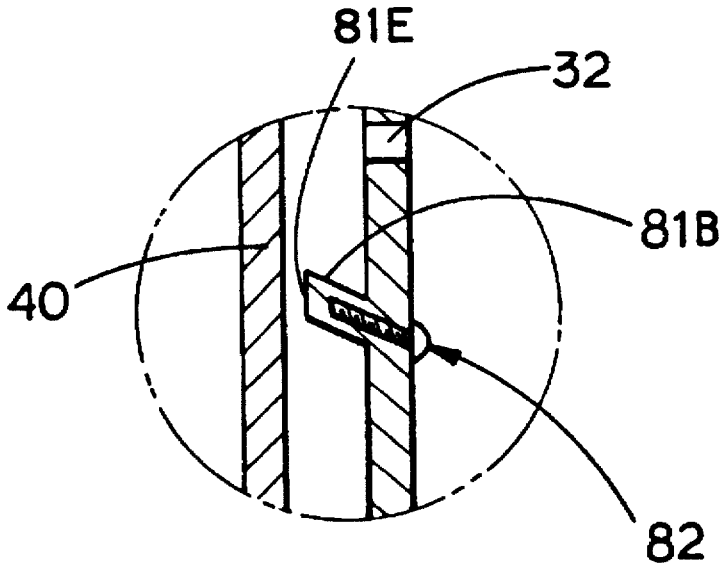
FIG. 2C is an enlarged cross-sectional view showing the portion of FIG. 2A disposed in a circle Y.

A washing machine according to the above embodiments operates as follows. In FIGS. 2A and 5A, the outer tub 30 and the inner tub 40 are assembled by the fixing means 50, and the tubs 30, 40 serve as a conventional washing tub or basket. The washing and rinsing modes are performed with a predetermined volume of laundry and water amount of water in the inner tub 40.

When the pulsator 70 is rotated in a clockwise or counterclockwise direction, the plurality of vanes 71 formed on the underside of the pulsator 70 serve as an impeller, developing a stream of water along the rotation direction of the pulsator 70.

When the pulsator 70 is rotated in a counterclockwise direction ( solid arrow A) as shown in FIG. 4, the water is forcefully inflowed into the water swirling means 80 through the inlet 41 by the rotational force of the vanes 71. The inflowing water is fed up across the upper surface of the collars 81A by the continuous rotational force of the vanes. Finally, the water is discharged into the inner tub 40 through the outlet 42.

The laundry is also being rotated in the counterclockwise direction in the same direction as a water flow being fed up across the inner side of the inner tub 40. The laundry rises above the water level of the inner tub and rotates in a counterclockwise direction along the inner side of the inner tub 40. The discharging water from the outlet 42 is showered down on the rotating laundry.

The laundry is more floatable according to the increase of the rotation speed of the pulsator. However, the discharge volume of the water through the outlet 42 is proportional to the rotation speed of the pulsator 70. The floatable laundry can be submerged below the water level of the inner tub by the water discharged from the outer tub.

Next, when the pulsator 70 is rotated in a clockwise direction (dotted arrow B) as shown in FIG. 4, the water is forcefully fed up across the upper surface of the collars 81B and is discharged into the inner tub 40 through the outlet 42. Since the further operation is the same as that of the counterclockwise rotation, the detailed explanation will be omitted.

During a washing operation, the laundry moves with the water flow developed by the rotation of the pulsator. The laundry rises up along the circumference of the ascending water. The continuous discharging water through the outlet 42 showers down on the rising laundry to increase washing efficiency.

In the spinning mode, the water separated from the laundry passes through the openings 32 formed in the outer tub 30 and the inner tub 40, draining out in a conventional method.

The conventional problem, insufficient immersion of laundry causing by the rising water along the circumference of the inner tub, can be solved by the invention.

As it is apparent from the above explanation, part of the water is drawn up by the rotation of the pulsator when in the washing and rinsing modes, and is showered down on the laundry of the inner tub to submerge the laundry below the water level of the inner tub. Therefore, the laundry is always submerged in the water, increasing the efficiency of both the washing and rinsings.

What is claimed is:

1. A clothes washing machine comprising:

a main water tub;

a laundry tub assembly mounted in the main water tub, and including:

an outer tub having a bottom wall and a side wall, and an inner tub disposed in the outer tub in radially spaced relationship therewith, the inner tub fixed to the outer tub and forming therewith a space having a lower water inlet and an upper water outlet;

an oscillatable pulsator mounted above the bottom wall of the outer tub for rotation in alternating clockwise and counterclockwise directions about a vertical axis, the pulsator including vanes which generate radially outward streams of water during rotation of the pulsator, the water streams entering the water inlet of the space and exiting the water outlet thereof to fall onto clothes being washed within the inner tub; and a water swirling structure disposed in the space for causing the water to be discharged from the water outlet in generally the same direction as the direction of rotation of the pulsator.

2. The clothes washing machine according to claim 1 wherein the water outlet comprises a continuous annular opening formed between upper edges of the outer and inner tubs.

3. The clothes washing machine according to claim 2 wherein the water swirling structure comprises spirally arranged members disposed within the space.

4. The clothes washing machine according to claim 3 wherein some of the spirally arranged members direct the water streams clockwise, and others of the spirally arranged members direct the water streams counterclockwise.

5. The clothes washing machine according to claim 4 wherein the spirally arranged members are mounted on an inner surface of the outer tub.

6. The clothes washing machine according to claim 4 wherein the spirally arranged members are mounted on an outer surface of the inner tub.

7. The clothes washing machine according to claim 1 wherein the water swirling structure comprises spirally arranged members disposed in the space.

8. The clothes washing machine according to claim 7 wherein some of the spirally arranged members direct the water streams clockwise, and others of the spirally arranged members direct the water streams counterclockwise.

9. The clothes washing machine according to claim 1 wherein the water swirling structure is mounted on an inner surface of the outer tub.

10. The clothes washing machine according to claim 1 wherein the water swirling structure is mounted on an outer surface of the inner tub.

* * * * *